US010812920B2

(12) United States Patent
Akahori

(10) Patent No.: US 10,812,920 B2
(45) Date of Patent: Oct. 20, 2020

(54) FAILURE DETERMINATION DEVICE AND SOUND OUTPUT DEVICE

(71) Applicant: LAPIS Semiconductor Co., Ltd., Yokohama (JP)

(72) Inventor: Hiroji Akahori, Yokohama (JP)

(73) Assignee: LAPIS SEMICONDUCTOR CO., LTD., Yokohama (JP)

( * ) Notice: Subject to any disclaimer, the term of this patent is extended or adjusted under 35 U.S.C. 154(b) by 0 days.

(21) Appl. No.: 16/725,509

(22) Filed: Dec. 23, 2019

(65) Prior Publication Data

US 2020/0236482 A1 Jul. 23, 2020

(30) Foreign Application Priority Data

Jan. 23, 2019 (JP) ..... 2019-009188

(51) Int. Cl.
*H04R 29/00* (2006.01)
*H04R 3/04* (2006.01)

(52) U.S. Cl.
CPC ..... *H04R 29/001* (2013.01); *H04R 3/04* (2013.01)

(58) Field of Classification Search
CPC ..... H04R 29/001; H04R 3/04
USPC ..... 381/59
See application file for complete search history.

(56) References Cited

U.S. PATENT DOCUMENTS 5,781,107 A * 7/1998 Ji ..... G08B 13/08 340/522
6,693,993 B2 * 2/2004 Toyota ..... H04M 11/04 340/573.1
6,940,986 B2 * 9/2005 Belenger ..... H03G 3/301 381/104
9,294,260 B2 * 3/2016 Giaconi ..... H04L 7/0334
9,430,185 B2 * 8/2016 Robinson ..... H03G 5/165
10,368,175 B2 * 7/2019 Kuriger ..... H04M 9/082
10,522,064 B2 * 12/2019 Taniguchi ..... G02F 1/134336
2006/0251264 A1 * 11/2006 Higashihara ..... G01H 13/00 381/58
2009/0009471 A1 * 1/2009 Yamamoto ..... G06F 3/0346 345/158

(Continued)

FOREIGN PATENT DOCUMENTS

JP 2014-230016 A 12/2014

*Primary Examiner* — Khai N. Nguyen
(74) *Attorney, Agent, or Firm* — Rabin & Berdo, P.C.

(57) ABSTRACT

A failure determination device allows a user to define conditions indicating a failure of the device. The failure determination device includes a difference detector configured to output a difference detection signal that indicates a difference between an input signal and an output signal output from a processor that performs a prescribed process on the input signal and a determination unit configured to output a determination signal indicating a determination result on presence or absence of a failure in the processor, based on the difference detection signal. A level detector outputs a level detection signal indicating whether a level of the input signal is within a prescribed range. The determination unit updates the determination signal when the level detection signal indicates that the level of the input signal is within the prescribed range, and stops updating the determination signal when the level detection signal indicates that the level of the input signal is not within the prescribed range.

10 Claims, 8 Drawing Sheets

(56) References Cited

U.S. PATENT DOCUMENTS

| | | | | |
|---|---|---|---|---|
| 2012/0038768 | A1* | 2/2012 | Fujimori | G08B 17/10 348/143 |
| 2015/0036838 | A1* | 2/2015 | Robinson | H03G 3/20 381/77 |
| 2015/0188693 | A1* | 7/2015 | Giaconi | H04L 7/0058 375/233 |
| 2015/0262576 | A1* | 9/2015 | Oda | G10L 21/0216 704/233 |
| 2017/0097805 | A1* | 4/2017 | Aoki | G06F 3/165 |
| 2018/0122281 | A1* | 5/2018 | Taniguchi | G02F 1/1396 |
| 2018/0329558 | A1* | 11/2018 | Park | G06F 3/0414 |
| 2019/0297433 | A1* | 9/2019 | Kuriger | H04M 9/082 |
| 2020/0105293 | A1* | 4/2020 | Mainiero | G10L 25/51 |

* cited by examiner

FAILURE DETERMINATION DEVICE AND SOUND OUTPUT DEVICE

BACKGROUND OF THE INVENTION

Technical Field

The present invention relates to a failure determination device and sound output device.

Background Arts

The following technology is known as technology related to failure detection in a sound output device. For example, Japanese Patent Application Laid-open Publication No. 2014-230016 describes a failure detection device configured to detect abnormality of an amplifier in an alarm device that includes an alarm sound generator configured to generate an alarm sound, an alarm signal transmitter configured to transmit an alarm signal to generate an alarm sound to the alarm sound generator, and an amplifier configured to amplify the alarm signal. The failure detection device of Japanese Patent Application Laid-open Publication No. 2014-230016 includes a detection signal transmitter that transmits a failure detection signal having two pulse waves with different polarities and phases, a first detection circuit that detects a first detection signal obtained by amplifying the failure detection signal by the amplifier and output from a positive-side output terminal, and a second detection circuit that detects a second detection signal obtained by amplifying the failure detection signal by the amplifier and output from a negative-side output terminal. A determination unit determines an abnormality of an amplifier based on the detected first detection signal and the second detection signal.

The definition of "failure" in a sound output device differs depending on how the sound output device is used by the user. For example, if the device is used for a purpose where the sound quality is important, even a small difference between the original sound and reproduced sound (sound output from a speaker) can be considered a failure. On the other hand, if the device is used for a purpose where the sound quality is not important such as emergency information, problems in sound quality are not considered a failure unless the problems are so significant that information is not properly communicated through sound.

Conventionally, it has not been possible for the designer of a failure determining function in the sound output device to define a failure. Instead, users have conventionally determined the criteria for failure determination.

One example of failure determination in a sound output device is a method using a difference between an input signal (original sound) and an output signal (reproduced sound). For example, if a difference between the input signal and the output signal is greater than a threshold value, the difference is considered a failure. The possible causes of a difference between the input signal and the output signal include non-linear distortion and noise.

FIG. 1 shows a case in which a difference between the input signal and the output signal is caused by non-linear distortion. For example, if the peak of the input signal is distorted by the distortion of the input/output characteristics of the amplifier, a harmonic component of the input signal is generated, which changes the sound. In a case where sound quality is important, the user is likely to consider the difference between the input signal and the output signal as illustrated in FIG. 1 as a failure. On the other hand, even when some distortions occur in the output signal, if the input signal still has a sufficient amount of frequency component, and the sound information by the input signal is sufficiently communicated, the user is not likely to consider the difference between the input signal and the output signal as illustrated in FIG. 1 as a failure.

FIG. 2 shows a case in which a difference between the input signal (original sound) and the output signal (reproduced sound) is caused by noise. When a noise component is superimposed over the input signal, a speaker outputs the original sound with noise. In a case where sound quality is important, the user might consider the difference between the input signal and the output signal as illustrated in FIG. 2 as a failure. On the other hand, even when the output sound includes noise, if the input signal still has a sufficient amount of frequency component, and the sound information by the input signal is sufficiently communicated, the user is not likely to consider the difference between the input signal and the output signal as illustrated in FIG. 2 as a failure.

In some cases, the timing at which the input signal is generated and the timing at which the noise component is generated differ from each other. For example, if the input signal is an audio signal, the input signal can include sections with larger amplitudes and sections with smaller amplitudes. On the other hand, the noise component is continuously superimposed over the input signal as long as there is a source of noise. In this case, the ratio of the noise component to the signal component continuously fluctuates. For example, when the amplitude of the input signal is zero (or in other words, the input audio level is zero), the ratio of the noise component to the signal component is 100%. On the other hand, when the amplitude of the input signal is relatively great, the ratio of the noise component to the signal component is smaller. If a failure is to be detected based on the ratio of the noise component to the signal component, this continuous change in the ratio of the noise component to the signal component makes it difficult to detect a failure.

SUMMARY OF THE INVENTION

The present invention has been developed in view of the above considerations and addresses various definitions of failure that vary depending on the user in failure determination.

A failure determination device according to an embodiment of the present invention includes: a difference detector configured to output a difference detection signal that indicates a difference between an input signal and an output signal output from a processor that performs a prescribed process on the input signal; a determination unit configured to output a determination signal indicating a determination result on presence or absence of a failure in the processor, based on the difference detection signal; and a level detector configured to output a level detection signal indicating whetehr the level of the input signal is within a prescribed range or not. The determination unit updates the determination signal when the level detection signal indicates that the level of the input signal is within the prescribed range, and stops updating the determination signal when the level detection signal indicates that the level of the input signal is not within the prescribed range.

A sound output device according to an embodiment of the present invention includes: a processor configured to perform a prescribed process on an input signal; a speaker configured to output a sound indicated by an output signal output from the processor; a difference detector configured to output a difference detection signal that indicates a difference between the input signal and the output signal; a determination unit configured to output a determination signal indicating a determination result of the presence or absence of a failure in the processor, based on the difference detection signal; and a level detector configured to output a level detection signal indicating whether the level of the input signal is within a prescribed range. The determination unit updates the determination signal when the level detection signal indicates that the level of the input signal is within the prescribed range, and stops updating the determination signal when the level detection signal indicates that the level of the input signal is not within the prescribed range.

According to embodiments of the present invention, it is possible to address different definitions of a failure that vary depending on the user in failure determination.

DETAILED DESCRIPTION OF THE INVENTION

Figure 1:
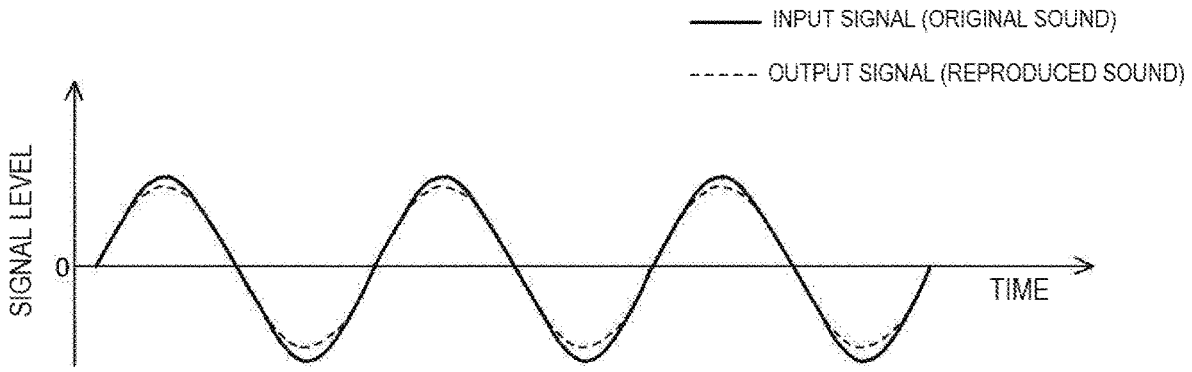
FIG. 1 is a diagram illustrating a difference between the input signal and the output signal caused by non-linear distortion.
Figure 2:
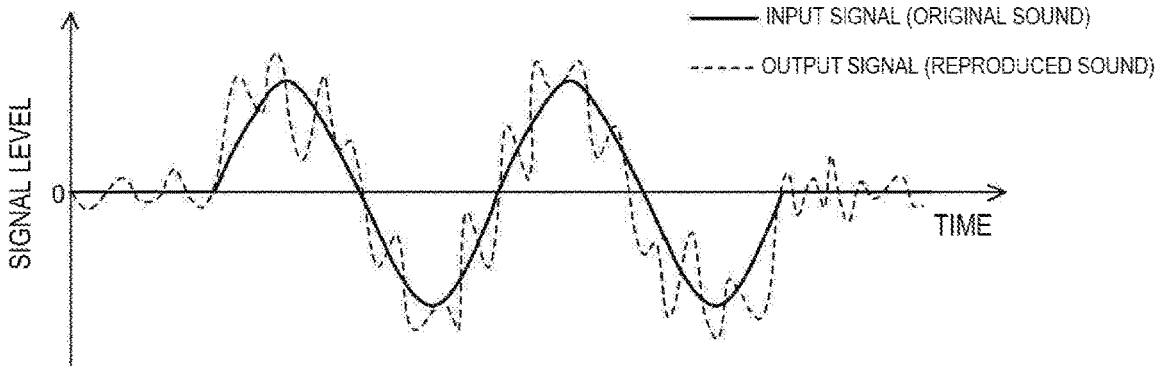
FIG. 2 is a diagram illustrating a difference between the input signal and the output signal caused by noise.

Below, embodiments of the present invention will be explained in detail with reference to figures. In each figure, components or parts that are substantially the same as or equivalent to each other are given the same reference characters.

Embodiment 1

Figure 3:
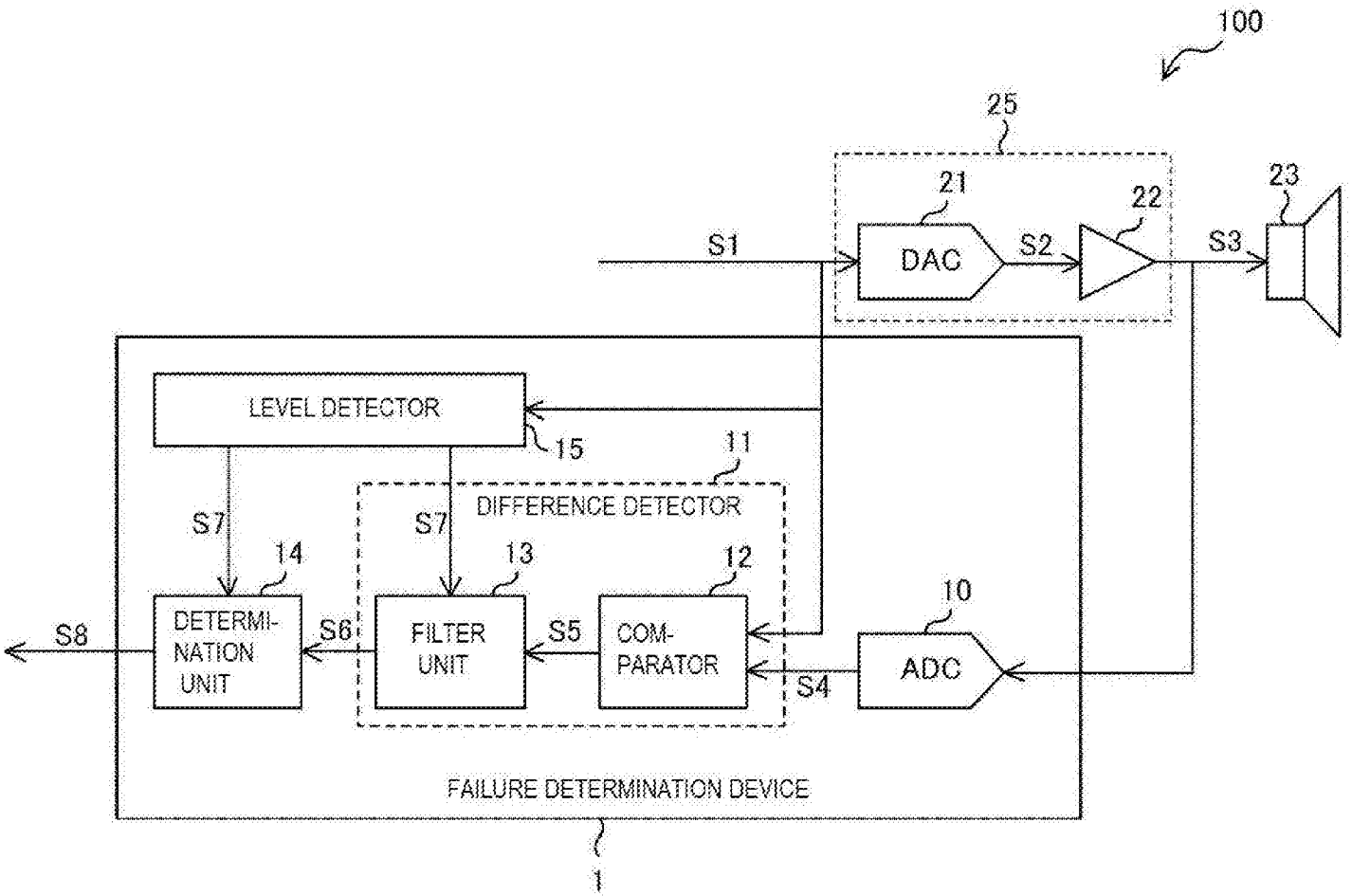
FIG. 3 is a block diagram illustrating an example of the configuration of a sound output device of an embodiment of the present invention.

FIG. 3 is a block diagram illustrating an example of the configuration of a sound output device 100 of Embodiment 1 of the present invention.

The sound output device 100 includes a failure determination device 1, a digital-analog convertor 21, a signal processor 22, and a speaker 23.

The digital-analog converter 21 converts an input signal S1, which a digital audio signal, to an analog signal S2, and outputs the analog signal S2.

The signal processor 22 outputs, as an output signal S3, a signal obtained by performing a prescribed process on the analog signal S2. The signal processor 22 performs at least one of the amplifying process to amplify the analog signal S2 and the filtering process to remove a specific frequency component from the analog signal S2, for example The speaker 23 converts the output signal S3 to sound and outputs the sound. The digital-analog converter 21 and a processor 25 including the signal processor 22 are one example of the processor of the present invention. In embodiments of the invention, the digital-analog converter 21 and the signal processor 22 may be either separate chips or circuits connected by one or more wiring lines, or part of a same processor chip. The signal processor 22 may include both active and passive circuitry, including comparators, amplifiers, and passive electrical components to perform the amplifying and filtering functions. In one embodiment, portions of the amplifying process and the filtering process performed by the signal processor 22 may be adjusted or programmed by software executed by a processing circuit. The processor 25 may be a single processing chip having both the digital-analog converter 21 and signal processor 22 therein, or the processor 25 may include more than one interconnected chips.

The failure determination device 1 has the function of determining whether or not a failure has occurred in the sound output device 100. More specifically, the failure determination device 1 determines whether a failure has occurred in at least one of the digital-analog converter 21 and the signal processor 22 based on a difference between the input signal S1 representing the original sound and the output signal S3 representing the reproduced sound. The failure determination device 1 includes an analog-digital converter 10, a difference detector 11, a determination unit 14, and a level detector 15. The difference detector 11 includes a comparator 12 and a filter unit 13. The filter unit 13 may include passive circuitry, including one or more capacitors and resistors to generate the difference detection signal S6. In one embodiment, the filter unit 13 functions as a low-pass filter and either includes an RC (resistor-capacitor) circuit, or includes electrical components performing equivalent functions.

The analog-digital converter 10 converts the output signal S3 of an analog format, which is output from the signal processor 22, to an output signal S4 of a digital format, and outputs the output signal S4.

The comparator 12 outputs a difference signal S5 indicating a difference between the input signal S1 and the output signal S4, which are continuously supplied, at respective points in time. The comparator 12 outputs, as the difference signal S5, an absolute value of the difference between the signal value (signal level) of the input signal S1 and the signal value (signal level) of the output signal S4.

The filter unit 13 outputs a difference detection signal S6, which is obtained by averaging out the signal values of the difference signal S5. That is, the filter unit 13 has the function equivalent to a low-pass filter, and by finding a time-average of the signal values of the difference signal S5, outputs the difference detection signal S6 that indicates a value obtained by averaging out differences between the input signal S1 and the output signal S4 over a prescribed period of time. The greater the difference between the input signal S1 and the output signal S4 is, the greater the signal value (signal level) of the difference detection signal S6 becomes.

The determination unit 14 determines whether a failure has occurred in at least one of the digital-analog converter 21 and the signal processor 22 based on the difference detection signal S6, and outputs a determination signal S8 indicating the determination result. For example, if the signal value (signal level) of the difference detection signal S6 is greater than a prescribed threshold value, the determination unit 14 outputs a determination signal S8 that indicates a failure has occurred in at least one of the digital-analog converter 21 and the signal processor 22. In this case, the determination unit 14 may output a determination signal S8 of a high level, for example. On the other hand, if the signal value (signal level) of the difference detection signal S6 is smaller than the prescribed threshold value, the determination unit 14 outputs a determination signal S8 that indicates no failure has occurred in the digital-analog converter 21 or the signal processor 22. In this case, the determination unit 14 may output the determination signal S8 of a low level, for example. The threshold value used in the determination process in the determination unit 14 may be set by a user to an appropriate value. The threshold value may be given hysteresis. This makes it possible to suppress unstability of the determination signal S8 caused by the fluctuation of the input signal S1. In one embodiment, the determination unit 14 includes one or more comparator circuits. The determination unit 14 may be a separate chip from the difference detector 11 and the level detector 15. In an alternative embodiment, one or more of the difference detector 11, the determination unit 14, and the level detector 15 may be formed in a same processing chip. In yet another embodiment, a processor may be programmed to perform detection and comparison functions of the difference detector, the determination unit, and the level detector 15.

Figure 4:
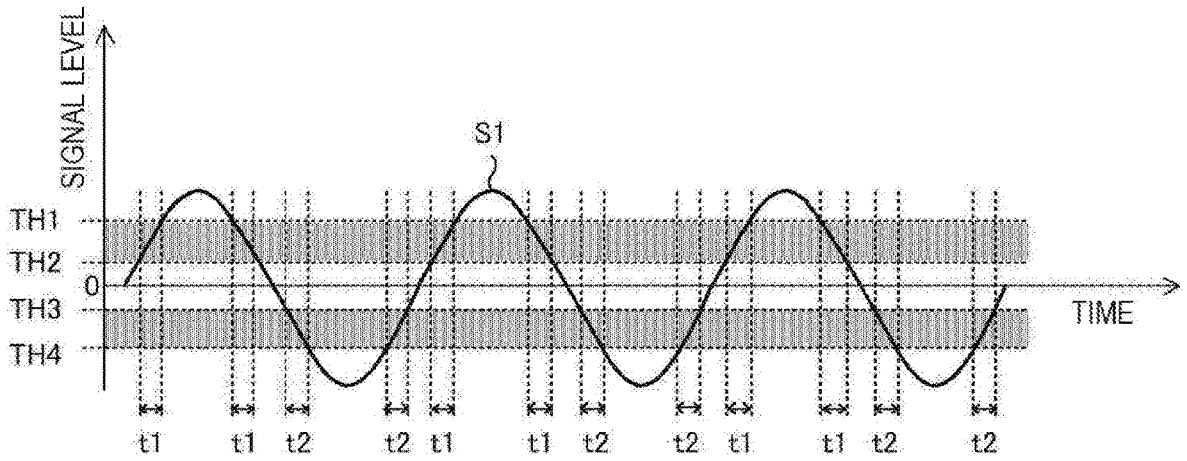
FIG. 4 is a diagram illustrating an example of the processes in the level detector of an embodiment of the present invention.

The level detector 15 outputs a level detection signal S7 indicating whether or not the level of the input signal S1 is within a prescribed range. The level detector 15 may include one or more comparator circuits. FIG. 4 is a diagram showing an example of the process performed in the level detector 15. The level detector 15 determines the level of the input signal S1 using four different threshold values TH1, TH2, TH3, and TH4, and outputs a level detection signal S7. In one embodiment, the level detector includes one or more comparator circuits to compare the input signal with the four different threshold values TH1, TH2, TH3, and TH4, and logic circuitry to output the detection signal S7 indicating whether the input signal falls within a range bounded by TH1 and TH2 or by TH3 and TH4. The levels of the threshold values TH1, TH2, TH3, and TH4 can change, and may be set to any appropriate values by a user. In the example of FIG. 4, TH1<TH2<TH3<TH4. The threshold values may be changed, for example, by altering a voltage applied to a comparator, or by adjusting an input or hardware configuration of a processor housing the level detector 15. Also, the prescribed range mentioned above is the range indicated with hatching in FIG. 4. That is, when the level of the input signal S1 is lower than the threshold value TH1 but higher than the threshold value TH2, and when the level of the input signal S1 is lower than the threshold value TH3 but higher than the threshold value TH4, the level of the input signal S1 is within the prescribed range.

The level detector 15 outputs the level detection signal S7 that indicates that the level of the input signal S1 is within the prescribed range during the period t1 in which the level of the input signal S1 is lower than the threshold value TH1 but higher than the threshold value TH2 and the period t2 in which the level of the input signal S1 is lower than the threshold value TH3 but higher than the threshold value TH4. In this case, the level detector 15 may output the level detection signal S7 of a high level, for example. On the other hand, during any other periods than t1 and t2 in which the input signal S1 is not within the prescribed range, the level detector 15 outputs the level detection signal S7 that indicates that the input signal S1 is not within the prescribed range. In this case, the level detector 15 may output the level detection signal S7 of a low level, for example. The level detection signal S7 is supplied to the filter unit 13 and the determination unit 14, respectively.

If the level detection signal S7 indicates that the level of the input signal S1 is within the prescribed range, the filter unit 13 updates the difference detection signal S6. That is, in this case, the filter unit 13 outputs the difference detection signal S6 that changes in accordance with the difference signal S5 supplied from the comparator 12. On the other hand, if the level detection signal S7 indicates that the level of the input signal S1 is not within the prescribed range, the filter unit 13 stops updating the difference detection signal S6. That is, in this case, the signal value (signal level) of the difference detection signal S6 does not change in accordance with the difference signal S5 supplied from the comparator 12, but instead maintains the immediately preceding value. In other words, even if the difference between the input signal S1 and the output signal S4 changes, the change would not be reflected on the difference detection signal S6.

Similarly, if the level detection signal S7 indicates that the level of the input signal S1 is within the prescribed range, the determination unit 14 updates the determination signal S8. That is, in this case, the determination unit 14 outputs the determination signal S8 that changes in accordance with the difference detection signal S6 supplied from the filter unit 13. On the other hand, if the level detection signal S7 indicates that the level of the input signal S1 is not within the prescribed range, the determination unit 14 stops updating the determination signal S8. That is, in this case, the signal value (signal level) of the determination signal S8 does not change in accordance with the difference detection signal S6 supplied from the filter unit 13, but instead maintains the immediately preceding value. In other words, even if the difference between the input signal S1 and the output signal S4 changes, the change would not be reflected on the determination signal S8. Thus, when the level of the input signal S1 is within the prescribed range, the failure determination in the failure determination device 1 is substantially stopped.

Below, the operation of the sound output device 100 will be explained.

The input signal S1, which is a digital-format audio signal, is converted to an analog signal by the digital-analog converter 21, and is output as the output signal S3 after undergoing an amplification process and a filtering process in the signal processor 22, for example. The speaker 23 converts the output signal S3 to sound and outputs the sound.

The output signal S3 is converted to an output signal S4 of a digital format in the analog-digital converter 10. The input signal S1 and the output signal S4 are supplied to the comparator 12, respectively.

Figure 5:
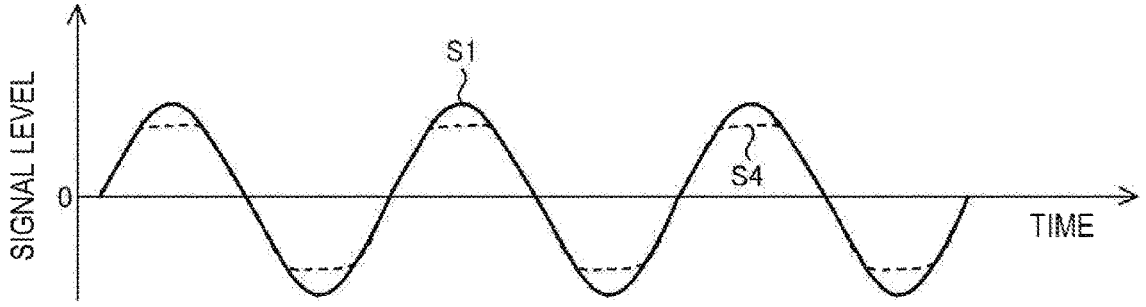
FIG. 5 is a diagram illustrating an example of an input signal and an output signal supplied to a comparator of an embodiment of the present invention.
Figure 6:
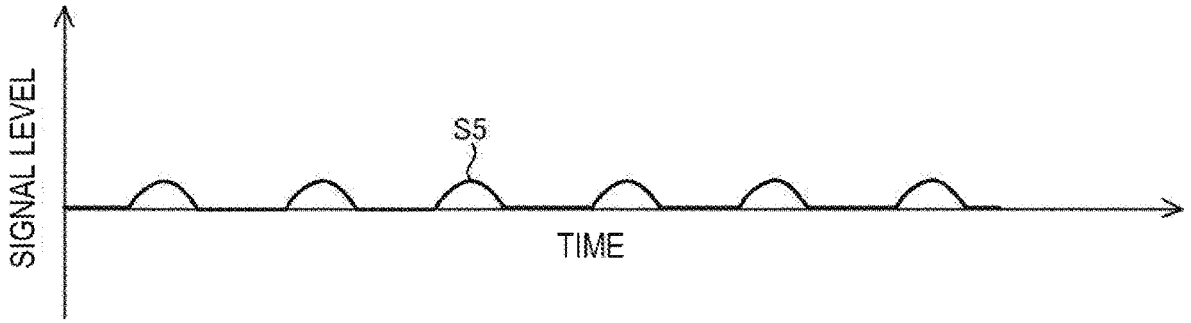
FIG. 6 is a diagram illustrating an example of a difference signal output from a comparator of an embodiment of the present invention.
Figure 7:
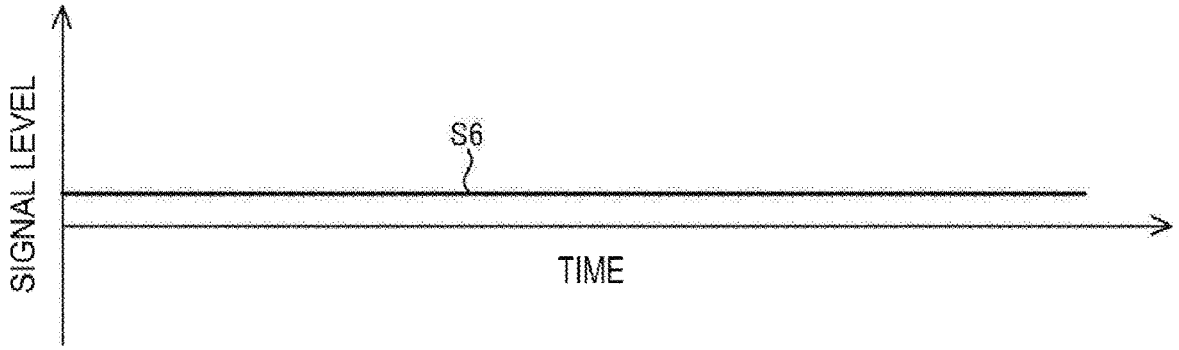
FIG. 7 is a diagram illustrating an example of a difference detection signal output from a filter unit of an embodiment of the present invention.

FIG. 5 is a diagram showing an example of the input signal S1 and output signal S4 supplied to the comparator 12. As shown in FIG. 6, the comparator 12 outputs, as the difference signal S5, an absolute value of the difference between the signal value (signal level) of the input signal S1 and the signal value (signal level) of the output signal S4.

The filter unit 13 outputs a difference detection signal S6, which is the time average of the signal values of the difference signal S5.

If the signal value (signal level) of the difference detection signal S6 is greater than a threshold value, the determination unit 14 outputs a determination signal S8 that indicates a failure has occurred in at least one of the digital-analog converter 21 and the signal processor 22. On the other hand, if the signal value (signal level) of the difference detection signal S6 is smaller than the threshold value, the determination unit 14 outputs a determination signal S8 that indicates no failure has occurred in the digital-analog converter 21 or the signal processor 22.

As shown in FIG. 4, the level detector 15 determines the level of the input signal S1 using four threshold values TH1, TH2, TH3, and TH4, for example, and outputs a level detection signal S7. The level detector 15 outputs the level detection signal S7 that indicates that the level of the input signal S1 is within a prescribed range during the period t1 in which the level of the input signal S1 is lower than the threshold value TH1 but higher than the threshold value TH2 and the period t2 in which the level of the input signal S1 is lower than the threshold value TH3 but higher than the threshold value TH4, for example.

If the level detection signal S7 indicates that the level of the input signal S1 is within the prescribed range, the filter unit 13 updates the difference detection signal S6. On the other hand, if the level detection signal S7 indicates that the level of the input signal S1 is not within the prescribed range, the filter unit 13 stops updating the difference detection signal S6. In this case, the signal value of the difference detection signal S6 maintains the immediately preceding value.

Similarly, if the level detection signal S7 indicates that the level of the input signal S1 is within the prescribed range, the determination unit 14 updates the determination signal S8. On the other hand, if the level detection signal S7 indicates that the level of the input signal S1 is not within the prescribed range, the determination unit 14 stops updating the determination signal S8. In this case, the signal value of the determination signal S8 maintains the immediately preceding value.

Figure 8:
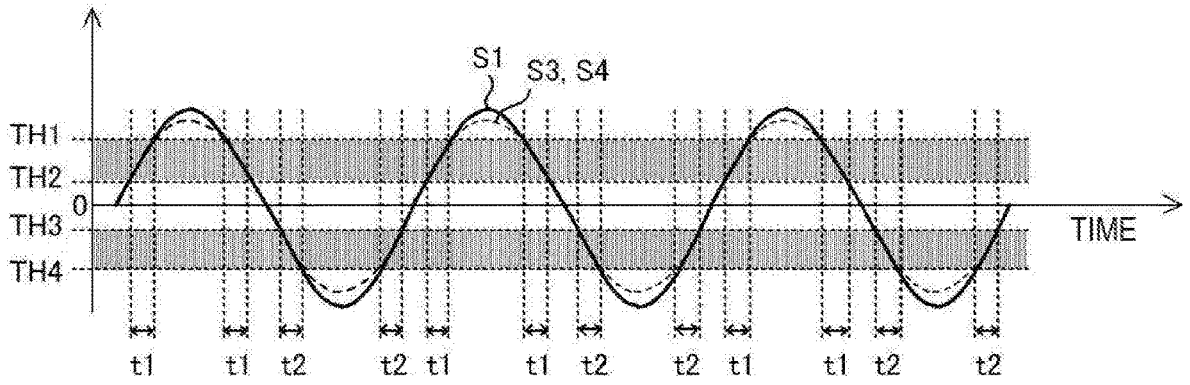
FIG. 8 is a diagram illustrating the effects of a failure determination device and sound output device of an embodiment of the present invention.

According to the failure determination device 1 and the sound output device 100 of Embodiment 1 of the present invention, as shown in FIG. 8, the level of the threshold value TH1 is set to be lower than the positive-side peak of the input signal S1, and the level of the threshold value TH4 is set to be higher than the negative-side peak of the input signal S1, so that the failure determination by the failure determination device 1 is substantially stopped when the input signal S1 is at the positive-side peak and when the input signal S1 is at the negative-side peak. Thus, as shown in FIG. 8, even when non-linear distortion occurs in the output signals S3 and S4, this distortion would not be detected as a failure. For example, in a case where a gain needs to be maximized in the amplification process performed by the signal processor 22 at the cost of causing distortions in the output signals S3 and S4, the distortion that occurs at the respective peaks on the positive-side and the negative-side of the input signal S1 would not be detected as a failure.

On the other hand, by setting the level of the threshold value TH1 to a level higher than the positive-side peak of the input signal S1, and setting the level of the threshold value TH4 to a level lower than the negative-side peak of the input signal S1, distortion that is more apparent at the peak sections of the input signal S1 can be detected as a failure.

Figure 9:
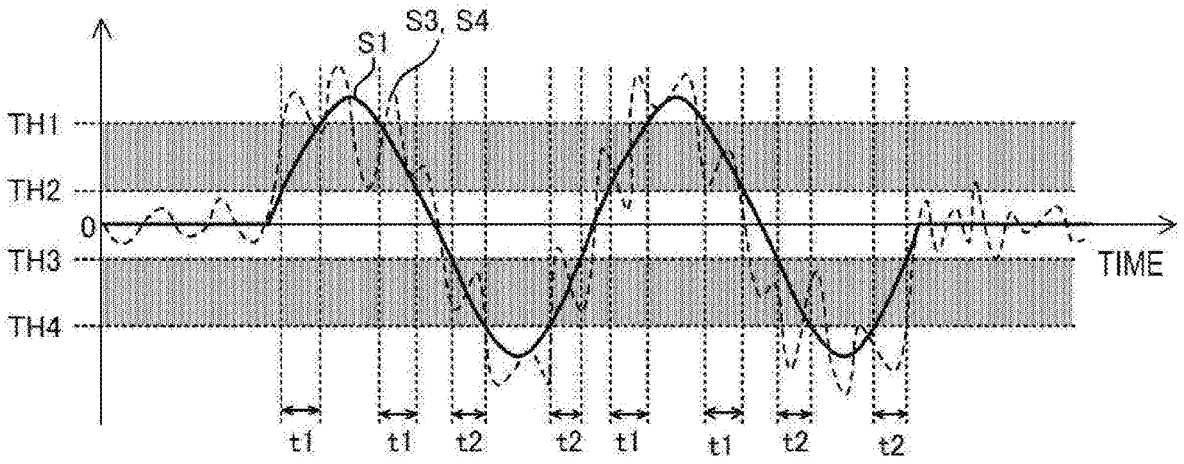
FIG. 9 is a diagram illustrating the effects of a failure determination device and sound output device of an embodiment of the present invention.

Also, as shown in FIG. 9, by setting the levels of the threshold value TH2 and the threshold value TH3 such that the level zero of the input signal S1 stays between the threshold value TH2 and the threshold value TH3, the failure determination by the failure determination device 1 can substantially be stopped when the level of the input signal S1 is zero or very small. Thus, in a case where the output signals S3 and S4 include noise, even if the ratio of the noise component to the signal component is higher when the level of the input signal S1 is near zero as shown in FIG. 9, this noise component would not be detected as a failure. This makes it possible to avoid variations in the result of failure determination caused by a change in level of the input signal S1 and a difference in length of the silent time.

As described above, with the failure determination device 1 and the sound output device 100 in this embodiment 1 of the present invention, it is possible to address definitions that vary depending on the user in failure determination.

In this embodiment, the level detector 15 determines the level of the input signal S1 using four threshold values TH1 to TH4, for example, but the present invention is not limited to this. The level detector 15 may use two or three threshold values to determine the level of the input signal S1, or may use five or more threshold values to determine the level of the input signal S1, for example.

In this embodiment, the failure determination device 1 was used for a sound output device, but the present invention is not limited to this embodiment. The failure determination device 1 may be used for a transmission device that includes a signal processor configured to perform prescribed processes on an input signal, and that sends out an output signal output from the signal processor. The input signal and the output signal do not have to be an audio signal, and there are no special limitations on the format of the input signal and the output signal, information included in those signals, or the like.

Embodiment 2

Figure 10:
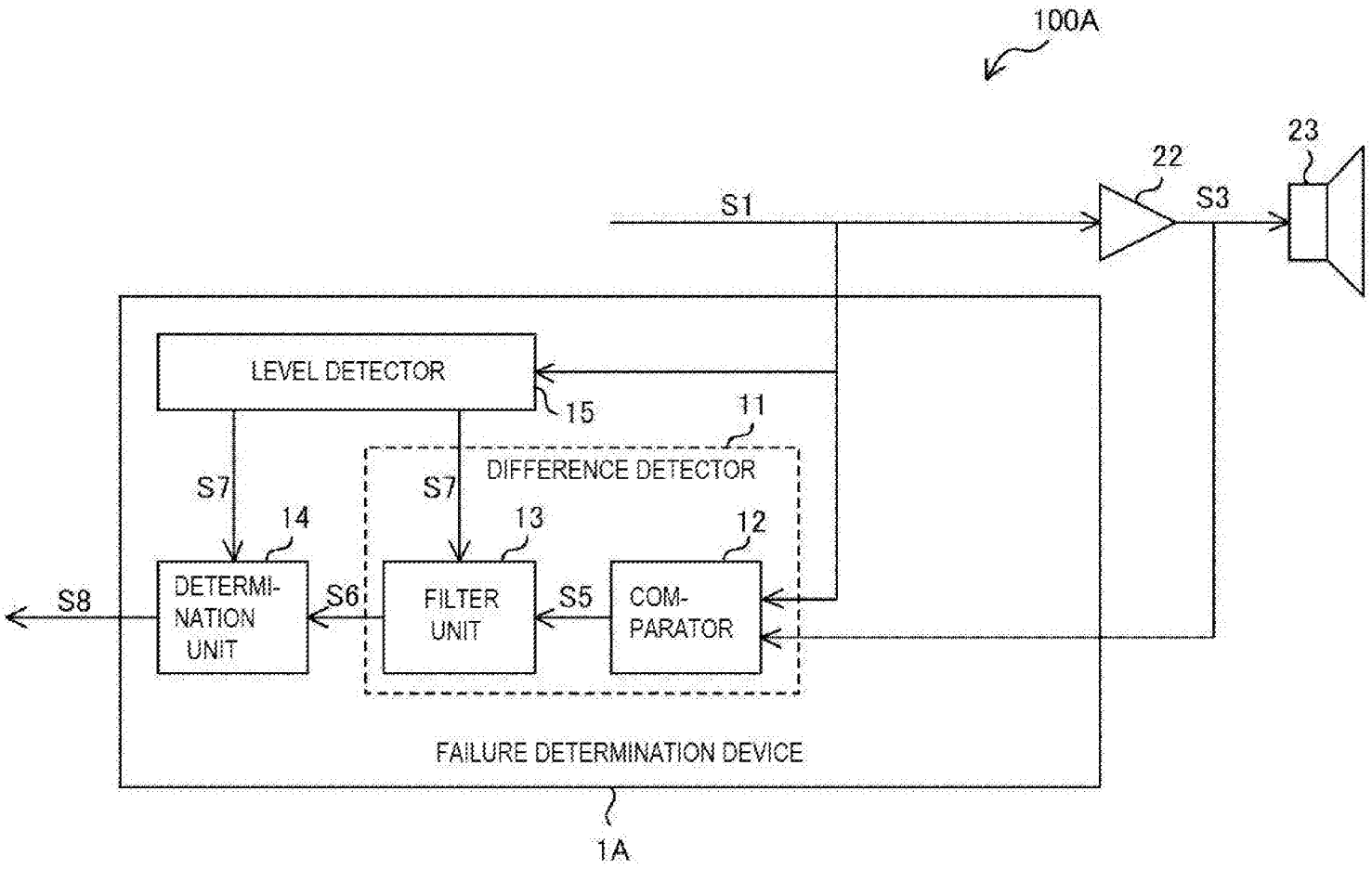
FIG. 10 is a block diagram illustrating an example of the configuration of a sound output device of another embodiment of the present invention.

FIG. 10 is a block diagram illustrating an example of the configuration of a sound output device 100 of Embodiment 2 of the present invention. In the sound output device 100A of Embodiment 2, an audio signal of analog format is supplied as the input signal S1. Thus, the sound output device 100A does not include the digital-analog converter 21 or the analog-digital converter 10 unlike the sound output device 100 of Embodiment 1 (see FIG. 3). The comparator 12, the filter unit 13, the determination unit 14 and the level detector 15 of the failure determination device 1A of this embodiment are all analog circuits.

With the sound output device 100A of Embodiment 2 of the present invention, effects similar to those of the sound output device 100 of Embodiment 1 are achieved.

Embodiment 3

Figure 11:
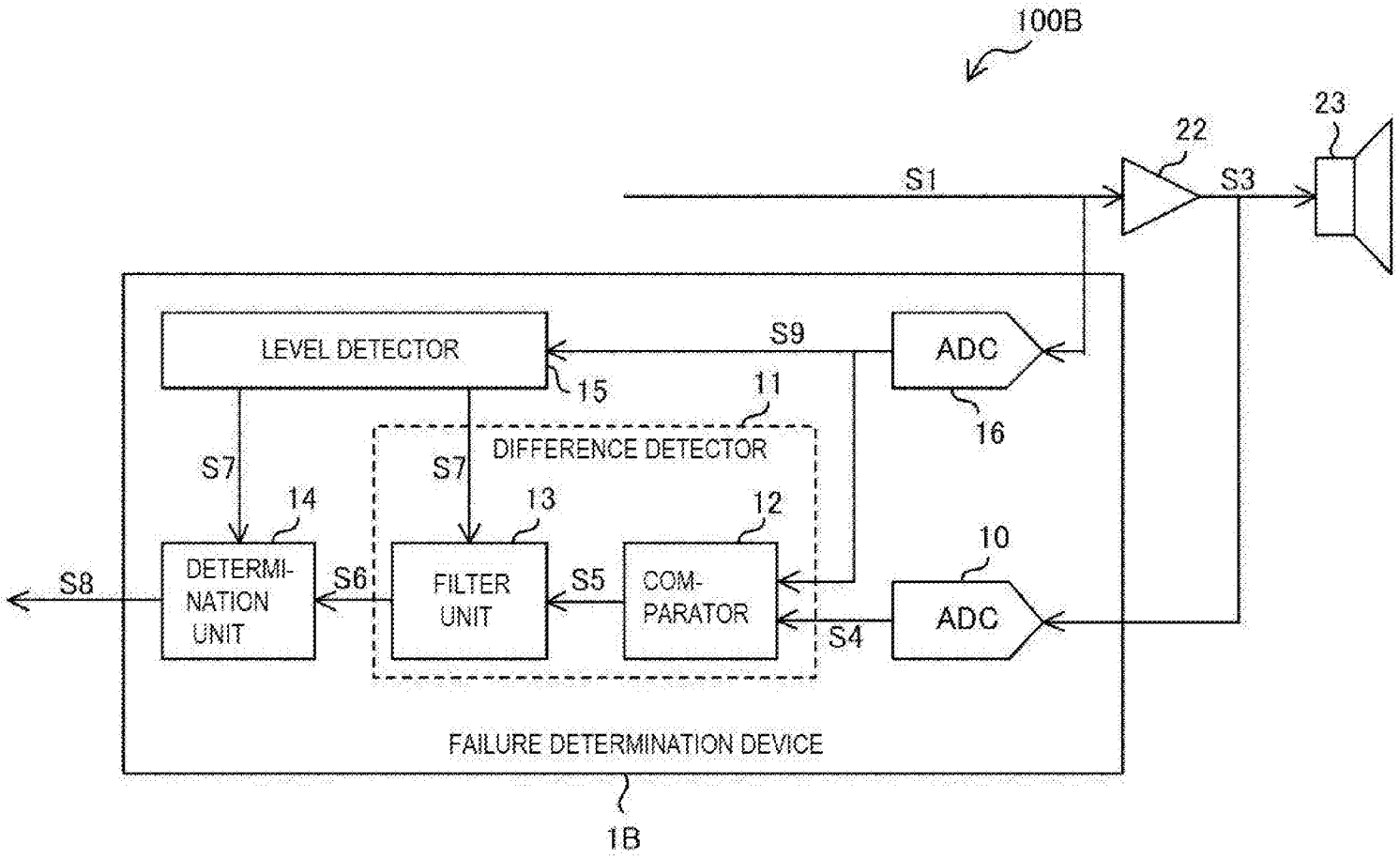
FIG. 11 is a block diagram illustrating an example of the configuration of a sound output device of another embodiment of the present invention.

FIG. 11 is a block diagram illustrating an example of the configuration of a sound output device 100B of Embodiment 3 of the present invention. In the sound output device 100B of Embodiment 3, an audio signal of analog format is supplied as the input signal S1. The failure determination device 1B of this embodiment includes an analog-digital converter 16 that converts the input signal S1 of analog format to the input signal S9 of digital format. The input signal S9 of digital format is supplied to the comparator 12 and the level detector 15, respectively. The comparator 12, the filter unit 13, the determination unit 14 and the level detector 15 of the failure determination device 1B are all digital circuits.

With the sound output device 100B of Embodiment 3 of the present invention, effects similar to those of the sound output device 100 of Embodiment 1 are achieved.

DESCRIPTIONS OF REFERENCE CHARACTERS

1, 1A, 1B Failure Determination Device
100, 100A, 100B Sound Output Device
10 Analog-digital Converter
11 Difference Detector
12 Comparator
13 Filer Unit
14 Determination Unit
15 Level Detector
21 Digital-analog Converter
22 Signal Processor
23 Speaker

What is claimed is:

1. A failure determination device, comprising:

a difference detector configured to output a difference detection signal indicating a difference between an input signal and an output signal output from a processor that performs a prescribed process on the input signal;

a determination unit configured to output a determination signal indicating a determination result on presence or absence of a failure in the processor, based on the difference detection signal; and a level detector configured to output a level detection signal indicating whether a level of the input signal is within a prescribed range, wherein the determination unit is configured to update the determination signal when the level detection signal indicates that the level of the input signal is within the prescribed range, and the determination unit is configured to stop updating the determination signal when the level detection signal indicates that the level of the input signal is not within the prescribed range.

2. The failure determination device according to claim 1, wherein the level detector determines a level of the input signal using a plurality of threshold values having different levels, and outputs the level detection signal.

3. The failure determination device according to claim 2, wherein the plurality of threshold values is adjustable.

4. The failure determination device according to claim 3, wherein the level detector outputs a level detection signal that indicates that a level of the input signal is within the prescribed range during a period in which a level of the input signal is lower than a first threshold value and higher than a second threshold value, and during a period in which a level of the input signal is lower than a third threshold value that is less than the second threshold value and higher than a fourth threshold value that is less than the third threshold value.

5. The failure determination device according to claim 4, wherein a level zero of the input signal is between the second threshold value and the third threshold value.

6. The failure determination device according to claim 5, wherein the level detector is configured such that a positive-side peak of the input signal is greater then the first threshold value and a negative-side peak of the input signal is smaller than the fourth threshold value.

7. The failure determination device according to claim 1, wherein the difference detector includes:

a comparator configured to output a difference signal that indicates a difference between the input signal and the output signal at respective points in time; and a filter unit configured to output, as the difference detection signal, a signal obtained by finding an average over time of the difference signals, and wherein the determination unit determines a level of the difference detection signal using a determination threshold value to determine whether a failure has occurred in the processor.

8. The failure determination device according to claim 7, wherein the filter unit stops updating the difference detection signal when the level detection signal indicates that a level of the input signal is not within the prescribed range, and wherein the filter unit updates the difference detection signal when the level detection signal indicates that a level of the input signal is within the prescribed range.

9. The failure determination device according to claim 1, wherein the input signal and the output signal are each an audio signal.

10. A sound output device, comprising:

a processor configured to perform a prescribed process on an input signal;

a speaker configured to output a sound in accordance with an output signal output from the processor;

a difference detector configured to output a difference detection signal that indicates a difference between the input signal and the output signal;

a determination unit configured to output a determination signal indicating a determination result indicating a presence or absence of a failure in the processor, based on the difference detection signal; and a level detector configured to output a level detection signal indicating whether a level of the input signal is within a prescribed range, wherein the determination unit updates the determination signal when the level detection signal indicates that the level of the input signal is within the prescribed range, and the determination unit stops updating the determination signal when the level detection signal indicates that the level of the input signal is not within the prescribed range.

* * * * *